US005642554A

United States Patent [19]

Sorensen et al.

[11] Patent Number: 5,642,554

[45] Date of Patent: Jul. 1, 1997

[54] CABLE TIE HAVING ENHANCED LOCKING ENGAGEMENT BETWEEN PAWL AND RATCHET TEETH ON TONGUE

[75] Inventors: Soren Christian Sorensen; Jens Ole Sorensen, both of Cayman, Cayman Islands

[73] Assignee: GB Electrical, Inc., Milwaukee, Wis.

[21] Appl. No.: 580,657

[22] Filed: Dec. 29, 1995

[51] Int. Cl.[6] ..... B65D 63/00

[52] U.S. Cl. ..... 24/16 PB; 24/17 AP

[58] Field of Search ..... 24/16 PB, 17 AP, 24/17 A, 17 B, 17 R, 30.5 P

[56] References Cited

U.S. PATENT DOCUMENTS

| | | | |
|---|---|---|---|
| 3,924,299 | 12/1975 | McCormick | 24/16 PB |
| 4,009,509 | 3/1977 | McCormick | 24/16 PB |
| 4,473,524 | 9/1984 | Paradis | 264/291 |
| 4,502,187 | 3/1985 | Kitagawa | 24/16 PB |
| 5,146,654 | 9/1992 | Caveney et al. | 24/16 PB |
| 5,389,330 | 2/1995 | Sorensen et al. | 264/328.1 |

FOREIGN PATENT DOCUMENTS

| | | | |
|---|---|---|---|
| 2309763 | 11/1976 | France | 24/16 PB |
| 2541444 | 4/1976 | Germany | 24/16 PB |
| 2145150 | 3/1985 | United Kingdom . | |

*Primary Examiner*—Victor N. Sakran

*Attorney, Agent, or Firm*—Edward W. Callan

[57] ABSTRACT

In a tie including an elongated tongue and a locking head having a movable pawl that is hinged at one side of an opening in the locking head across the opening from an abutment surface for locking engagement with a first set of ratchet teeth on one broad side of the tongue when the tip of the tongue has been inserted through the opening and teeth on the abutment surface for locking engagement with a second set of ratchet teeth on the other broad side of the tongue when the tip of the tongue has been inserted through the opening, and in which the side of the pawl including the pawl teeth converges toward the opposite side of the pawl in the direction of insertion, locking engagement is enhanced by the locking surface of at least one pawl tooth extending toward the apex of such tooth at an angle inclined toward the direction of insertion for locking engagement with a tooth of the first set of ratchet teeth; and by the locking surface of at least one of the first set of ratchet teeth extending toward the apex of such tooth at an angle inclined away from the direction of insertion for locking engagement with a pawl tooth.

12 Claims, 1 Drawing Sheet

FIG.1
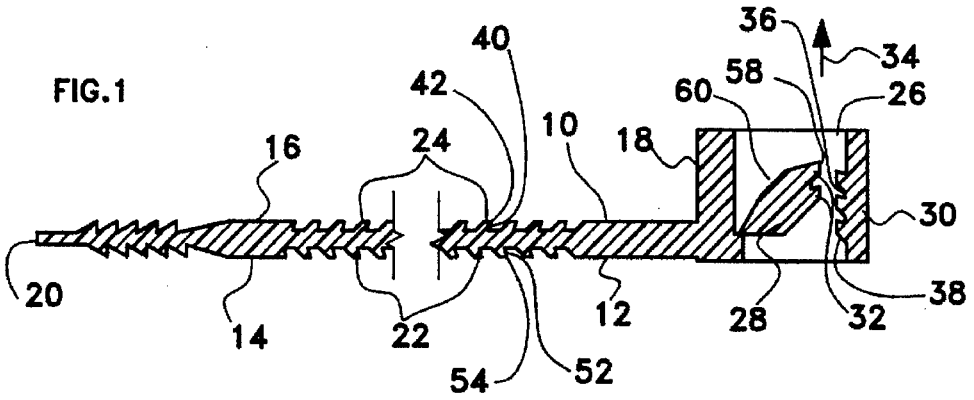
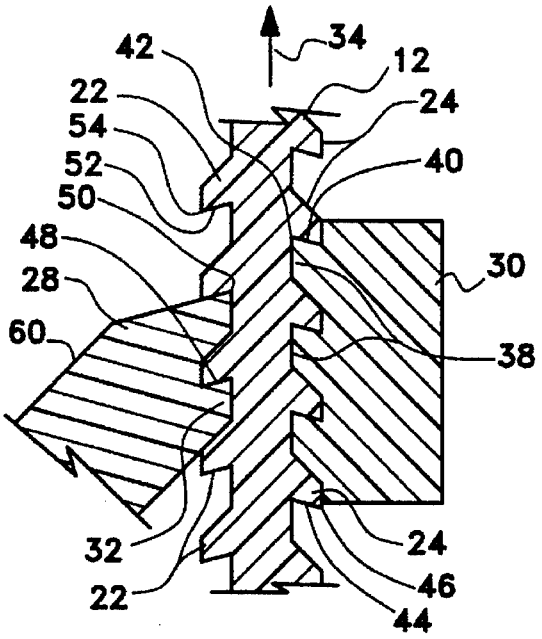
FIG.2
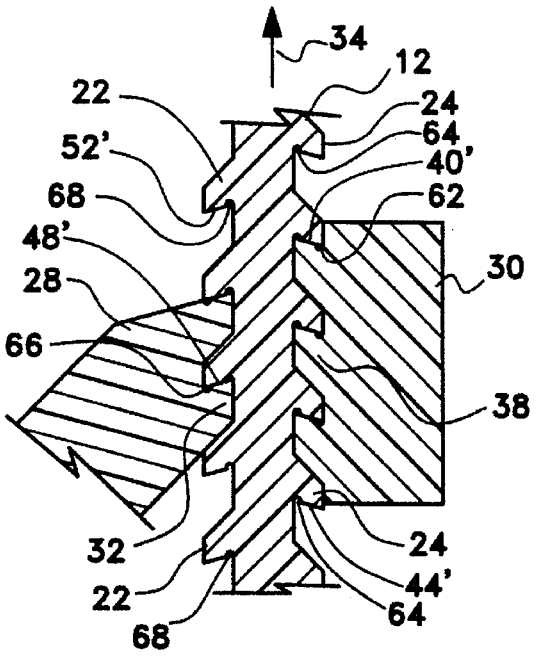
FIG.3

CABLE TIE HAVING ENHANCED LOCKING ENGAGEMENT BETWEEN PAWL AND RATCHET TEETH ON TONGUE

BACKGROUND OF THE INVENTION

The present invention pertains to a tie that is useful for forming a loop for retaining a bundle of elongated articles, such as cables. Such a tie is commonly known as a cable tie.

One type of tie includes an elongated tongue with two ends and two broad sides, a locking head at one end of the tongue, a tip at the other end of the tongue, a first set of ratchet teeth extending along one broad side of the tongue and a second set of ratchet teeth extending along the other broad side of the tongue, wherein the locking head has sides defining an opening for receiving the tip of the tongue, the sides including a movable pawl that is hinged at one side of the opening and an abutment surface that is across the opening from the pawl, wherein the pawl has at least one pawl tooth disposed for engaging the first set of ratchet teeth when the tip of the tongue has been inserted through the opening with the first set of ratchet teeth facing the pawl, wherein the pawl, when the at least one pawl tooth is so engaged, is movable toward the abutment surface in response to pressure applied to the tongue in a direction opposite to the direction of insertion in order to force the second set of ratchet teeth against the abutment surface; and wherein at least one tooth is disposed on the abutment surface for engaging the second set of ratchet teeth when the tip of the tongue has been inserted through the opening with the second set of ratchet teeth facing the abutment surface and the side of the tongue including the second set of ratchet teeth is forced against the abutment surface by movement of the pawl. Such a tie is described in U.S. Pat. No. 4,473,524 to Paradis.

In a tie described in published UK Patent Application No. GB 2 145 150 A, each of the pawl teeth has a locking surface extending toward an apex of the tooth at an angle the tongue has been inserted through the opening with the set of ratchet teeth facing the pawl; and wherein the side of the pawl including/he at least one tooth converges toward the opposite side of the pawl in said direction of insertion.

According to another aspect of the present invention, the tie comprises an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl, wherein at least one tooth of the set of ratchet teeth has a locking surface extending toward an apex of said tooth at an angle inclined away from said direction of insertion for locking engagement with the at least one pawl tooth when the tongue has been inserted through the opening with the set of ratchet teeth facing the pawl; and wherein the side of the pawl including the at least one tooth converges toward the opposite side of the pawl in said direction of insertion.

Both of the above aspects of the present invention are combined in the preferred embodiment.

Additional features of the present invention are described with reference to the detailed description of the preferred embodiments. inclined toward the direction of said insertion for locking engagement with a tooth of the set of ratchet teeth when the tongue has been inserted through the opening with the set of ratchet teeth facing the pawl; and each of the ratchet teeth on the one side of the tongue has a locking surface extending toward an apex of the tooth at an angle inclined away from the direction of insertion for locking engagement with a pawl tooth when the tongue has been inserted through the opening with the set of ratchet teeth facing the pawl. In such tie, the side of the pawl including the teeth diverges away from the opposite side of the pawl in the direction of insertion, whereby the tie is not readily removable from a mold when the tie is manufactured by injection molding.

SUMMARY OF THE INVENTION

The present invention provides a tie having enhanced locking engagement between the at least one pawl tooth and the first set of ratchet teeth on the tongue, and which is readily removable from a mold when the tie is manufactured by injection molding.

According to one aspect of the present invention, the tie comprises an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl, wherein the at least one pawl tooth has a locking surface extending toward an apex of said tooth at an angle inclined toward the direction of said insertion for locking engagement with the set of ratchet teeth when

BRIEF DESCRIPTION OF THE DRAWING

FIG. 1 is a fragmentary sectional view of one preferred embodiment of a tie according to the present invention.

FIG. 2 is an enlarged sectional view illustrating the engagement of the ratchet teeth on the tongue with the abutment surface teeth and the pawl teeth within the locking head of the tie shown in FIG. 1.

FIG. 3 is an enlarged sectional view illustrating the engagement of the ratchet teeth on the tongue with the abutment surface teeth and the pawl teeth within the locking head of an alternative embodiment of a tie according to the present invention.

DETAILED DESCRIPTION

Referring to FIGS. 1 and 2, a preferred embodiment of the tie 10 of the present invention includes an elongated tongue 12 with two ends and two broad sides 14, 16, a locking head 18 at one end of the tongue, a tip 20 at the other end of the tongue 12, a first set of ratchet teeth 22 extending along one broad side 14 of the tongue 12 and a second set of ratchet teeth 24 extending along the other broad side 16 of the tongue 12. The locking head 18 has sides defining an opening 26 for receiving the tip 20 of the tongue 12. The sides include a movable pawl 28 that is hinged at one side of the opening 26 and an abutment wall 30 that is across the opening 26 from the pawl 28. The pawl 28 has pawl teeth 32 disposed for locking engagement with the set of ratchet teeth 22 when the tip 20 of the tongue 12 has been inserted through the opening 26 with the ratchet teeth 22 facing the pawl 28. When at least one pawl tooth 32 is so engaged, the pawl 28 is movable toward the abutment wall 30 in response to a pulling force applied to the tongue 12 in a direction opposite to the direction of insertion 34 in order to force the tongue 12 against an abutment surface 36 of the abutment wall 30. Teeth 38 are disposed on the abutment surface 36 for engaging the second set of ratchet teeth 24 when the tip 20 of the tongue 12 has been inserted through the opening 26 with the second set of ratchet teeth 24 facing the abutment surface 36 and the side 16 of the tongue 12 including the second set of ratchet teeth 24 is forced against the abutment surface 36 by movement of the pawl 28 in response to a pulling force applied to the tongue 12 in a direction opposite to the direction of insertion 34.

Each of the abutment wall teeth 38 has a locking surface 40 extending toward an apex 42 of the tooth 38 at an angle inclined toward the direction of insertion 34 for locking engagement with a tooth of the second set of ratchet teeth 24 when the tongue 12 has been inserted through the opening 26 with the second set of ratchet teeth 34 facing the abutment surface 36 and the side 16 of the tongue 12 including the second set of ratchet teeth 24 is forced against the abutment surface 36 by movement of the pawl 28 in response to a pulling force applied to the tongue 12 in a direction opposite to the direction of insertion 34.

Each of the second set of ratchet teeth 24 has a locking surface 44 extending toward an apex 46 of the tooth 24 at an angle inclined away from the direction of insertion for locking engagement with a tooth 38 of the abutment surface 36 when the tongue 12 has been inserted through the opening 26 with the second set of ratchet teeth 24 facing the abutment surface 36 and the side 16 of the tongue 12 including the second set of ratchet teeth 24 is forced against the abutment surface 36 by movement of the pawl 28. The angle of inclination of the locking surface 40 of each tooth 38 on the abutment surface 36 is the same as the angle of inclination of the locking surface 44 of each of the second set of ratchet teeth 24.

Each pawl tooth 32 has a locking surface 48 extending toward an apex 50 of the tooth 32 at an angle inclined toward the direction of insertion 34 for locking engagement with a tooth of the first set of ratchet teeth 22 when the tongue 12 has been inserted through the opening 26 with the first set of ratchet teeth 22 facing the pawl 28. The angle of inclination of the locking surface 48 of the pawl tooth is defined as the angle of inclination of the locking surface 48 with respect to the direction of insertion 34 when the pawl teeth 32 are in locking engagement with the set of ratchet teeth 22 and the pawl 28 has moved to force the tongue 12 against the abutment surface 36.

Each of the first set of ratchet teeth 22 has a locking surface 52 extending toward an apex 54 of the tooth 22 at an angle inclined away from the direction of insertion 34 for locking engagement with a pawl tooth 32 when the tongue 12 has been inserted through the opening 26 with the set of ratchet teeth 22 facing the pawl 28. The angle of inclination of the locking surface 48 of each pawl tooth 32 is the same as the angle of inclination of the locking surface 52 of each of the first set of ratchet teeth 22.

The side 58 of the pawl 28 including the teeth 32 converges toward the opposite side 60 of the pawl 28 in the direction of insertion 34.

The abutment surface 36 also converges toward the opposite side 60 of the pawl 28 in the direction of insertion 34 to further ease the removal of the tie from the mold when the tie 10 is made by injection molding.

Ties 10 according to the present invention are made by injection molding plastic material into a mold defining mold cavities for forming the ties 10.

In an alternative preferred embodiment shown in FIG. 3, there are notches 62, 64, 66, 68 adjacent the respective locking surfaces 40', 44', 48', 52' of at least some of the abutment surface teeth 38, the second set of ratchet teeth 24, the pawl teeth 28 and/or the first set of ratchet teeth 22. Such locking surfaces 40', 44', 48', 52' do not extend into such notches 62, 64, 66, 68. A locking surface is only that portion a surface that contacts another surface for locking the tongue 12 in the locking head 18. Except for such notches 62, 64, 66, 68, the embodiment of FIG. 3 is the same as the embodiment of FIGS. 1 and 2.

In other preferred embodiments (not shown), the tie is the same as described with reference to FIGS. 1 and 2 and/or 3, except that there are no teeth on the abutment surface and there is not a second set of ratchet teeth on the other broad side of the tongue that faces the abutment wall when the pawl teeth are engaged with the first set of ratchet teeth.

In other alternative embodiments (not shown), (a) there is only one tooth 38 on the abutment surface 36, with such tooth 38 being inclined at an angle toward the direction of insertion 34 for locking engagement with a tooth 24 of the second set of ratchet teeth 24; (b) less than all of the second set of ratchet teeth 24 are inclined at an angle away from the direction of insertion for locking engagement with a tooth 38 on the abutment surface 36; (c) there is only one pawl tooth 32, with such tooth 32 being inclined at an angle toward the direction of insertion 34 for locking engagement with a tooth 22 of the first set of ratchet teeth 22; and/or (d) less than all of the first set of ratchet teeth 22 are inclined at an angle away from the direction of insertion 34 for locking engagement with a pawl tooth 32.

The features of at least one abutment surface tooth being inclined at an angle toward the direction of insertion for locking engagement with a tooth of the second set of ratchet teeth; and at least one of the second set of ratchet teeth being inclined at an angle away from the direction of insertion for locking engagement with an abutment surface tooth are the subject of U.S. patent application Ser. No. 08/530,653 filed by applicants on even date herewith, entitled "Cable Tie Having Enhanced Locking Engagement Between Abutment Surface Teeth And Ratchet Teeth On Tongue".

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as exemplifications of the preferred embodiments described herein. Other variations are possible and the scope of the present invention should be determined not by the embodiments described herein but rather by the claims and their legal equivalents.

We claim:

1. A tie comprising an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl, wherein the at least one pawl tooth has a locking surface extending toward an apex of said tooth at an angle inclined toward the direction of said insertion for locking engagement with the set of ratchet teeth when the tongue has been inserted through the opening with the set of ratchet teeth facing the pawl;

wherein the side of the pawl including the at least one tooth converges toward the opposite side of the pawl in said direction of insertion wherein the abutment surface also converges toward the opposite side of the pawl in said direction of insertion.

2. A tie according to claim 1, further comprising a second set of ratchet teeth extending along the other broad side of the tongue;

wherein the pawl, when the at least one pawl tooth is so engaged, is movable toward the abutment surface in response to a pulling force applied to the tongue in a direction opposite to the direction of said insertion in order to force the second set of ratchet teeth against the abutment surface; and wherein the abutment surface includes at least one tooth having a locking surface extending toward an apex of the tooth at an angle inclined toward said direction of insertion for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl.

3. A tie according to claim 1, further comprising a second set of ratchet teeth extending along the other broad side of the tongue;

wherein the pawl, when the at least one pawl tooth is so engaged, is movable toward the abutment surface in response to a pulling force applied to the tongue in a direction opposite to the direction of said insertion in order to force the second set of ratchet teeth against the abutment surface;

wherein the abutment surface includes at least one tooth having a locking surface extending toward an apex of the tooth for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl; and wherein at least one tooth of the second set of ratchet teeth has a locking surface extending toward an apex of said tooth at an angle inclined away from said direction of insertion for locking engagement with the at least one tooth of the abutment surface when the tongue has been inserted through the opening with the second set of ratchet teeth facing the abutment surface and the side of the tongue including the second set of ratchet teeth is forced against the abutment surface by movement of the pawl.

4. A tie according to claim 3, wherein the locking surface of said at least one tooth of the abutment surface extends toward said apex of said tooth at an angle inclined toward said direction of insertion for said locking engagement with the second set of ratchet teeth.

5. A tie according to claim 4, wherein the angle of inclination of the locking surface of each said at least one tooth of the abutment surface is the same as the angle of inclination of the locking surface of each said at least one tooth of the second set of ratchet teeth.

6. A tie comprising an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl, wherein at least one tooth of the set of ratchet teeth has a locking surface extending toward an apex of said tooth at an angle inclined away from said direction of insertion for locking engagement with the at least one pawl tooth when the tongue has been inserted through the opening with the set of ratchet teeth facing the pawl;

wherein the side of the pawl including the at least one tooth converges toward the opposite side of the pawl in said direction of insertion wherein the abutment surface also converges toward the opposite side of the pawl in said direction of insertion.

7. A tie according to claim 6, wherein the at least one pawl tooth has a locking surface extending toward an apex of said tooth at an angle inclined toward the direction of said insertion for locking engagement with the set of ratchet teeth when the tongue has been inserted through the opening with the set of ratchet teeth facing the pawl.

8. A tie according to claim 7, wherein the angle of inclination of the locking surface of each said at least one tooth of the pawl is the same as the angle of inclination of the locking surface of each said at least one tooth of the set of ratchet teeth.

9. A tie according to claim 7, further comprising a second set of ratchet teeth extending along the other broad side of the tongue;

wherein the pawl, when the at least one pawl tooth is so engaged, is movable toward the abutment surface in response to a pulling force applied to the tongue in a direction opposite to the direction of said insertion in order to force the second set of ratchet teeth against the abutment surface; and wherein the abutment surface includes at least one tooth having a locking surface extending toward an apex of the tooth at an angle inclined toward said direction of insertion for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl.

10. A tie according to claim 7, further comprising a second set of ratchet teeth extending along the other broad side of the tongue;

wherein the pawl, when the at least one pawl tooth is so engaged, is movable toward the abutment surface in response to a pulling force applied to the tongue in a direction opposite to the direction of said insertion in order to force the second set of ratchet teeth against the abutment surface;

wherein the abutment surface includes at least one tooth having a locking surface extending toward an apex of the tooth for locking engagement with the second set of ratchet teeth when the tongue has been inserted through the opening with the second set of ratchet teeth facing the abutment surface and the side of the tongue including the second set of ratchet teeth is forced against the abutment surface by movement of the pawl; and wherein at least one tooth of the second set of ratchet teeth has a locking surface extending toward an apex of said tooth at an angle inclined away from said direction of insertion for locking engagement with the at least one tooth of the abutment surface when the tongue has been inserted through the opening with the second set of ratchet teeth facing the abutment surface and the side of the tongue including the second set of ratchet teeth is forced against the abutment surface by movement of the pawl.

11. A tie according to claim 10, wherein the locking surface of said at least one tooth of the abutment surface extends toward said apex of said tooth at an angle inclined toward said direction of insertion for said locking engagement with the second set of ratchet teeth.

12. A tie according to claim 11, wherein the angle of inclination of the locking surface of each said at least one tooth of the abutment surface is the same as the angle of inclination of the locking surface of each said at least one tooth of the second set of ratchet teeth.

* * * * *

UNITED STATES PATENT AND TRADEMARK OFFICE

CERTIFICATE OF CORRECTION

PATENT NO. : 5,642,554
DATED : July 1, 1997
INVENTOR(S) : Soren Christian Sorensen et al.

It is certified that error appears in the above-indentified patent and that said Letters Patent is hereby corrected as shown below:

The text beginning with "the tongue" at column 1, lines 38 and continuing through "embodiments." at column 2, line 1 should be relocated so as to be after "when" in column 2, line 39.

Column 1, line 41, "including/he" should read --including the--.

Signed and Sealed this

Twenty-eighth Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,642,554
DATED : Jul. 1, 1997
INVENTOR(S) : Sorensen et al.

It is certified that error appears in the above-identified patent and that said Letters Patent is hereby corrected as shown below:

Please delete columns 1-2 and substitute columns 1-2 appear as per attached.

This certificate supersedes Certificate of Correction issued October 28, 1997.

Signed and Sealed this

First Day of December, 1998

*Attest:*

*Attesting Officer*

BRUCE LEHMAN

*Commissioner of Patents and Trademarks*

CABLE TIE HAVING ENHANCED LOCKING ENGAGEMENT BETWEEN PAWL AND RATCHET TEETH ON TONGUE

BACKGROUND OF THE INVENTION

The present invention pertains to a tie that is useful for forming a loop for retaining a bundle of elongated articles, such as cables. Such a tie is commonly known as a cable tie.

One type of tie includes an elongated tongue with two ends and two broad sides, a locking head at one end of the tongue, a tip at the other end of the tongue, a first set of ratchet teeth extending along one broad side of the tongue and a second set of ratchet teeth extending along the other broad side of the tongue, wherein the locking head has sides defining an opening for receiving the tip of the tongue, the sides including a movable pawl that is hinged at one side of the opening and an abutment surface that is across the opening from the pawl, wherein the pawl has at least one pawl tooth disposed for engaging the first set of ratchet teeth when the tip of the tongue has been inserted through the opening with the first set of ratchet teeth facing the pawl, wherein the pawl, when the at least one pawl tooth is so engaged, is movable toward the abutment surface in response to pressure applied to the tongue in a direction opposite to the direction of insertion in order to force the second set of ratchet teeth against the abutment surface; and wherein at least one tooth is disposed on the abutment surface for engaging the second set of ratchet teeth when the tip of the tongue has been inserted through the opening with the second set of ratchet teeth facing the abutment surface and the side of the tongue including the second set of ratchet teeth is forced against the abutment surface by movement of the pawl. Such a tie is described in U.S. Pat. No. 4,473,524 to Paradis.

In a tie described in published UK Patent Application No. GB 2 145 150 A, each of the pawl teeth has a locking surface extending toward an apex of the tooth at an angle inclined toward the direction of said insertion for locking engagement with a tooth of the set of ratchet teeth when the tongue has been inserted through the opening with the set of ratchet teeth facing the pawl; and each of the ratchet teeth on the one side of the tongue has a locking surface extending toward an apex of the tooth at an angle inclined away from the direction of insertion for locking engagement with a pawl tooth when the tongue has been inserted through the opening with the set of ratchet teeth facing the pawl. In such tie, the side of the pawl including the teeth diverges away from the opposite side of the pawl in the direction of insertion, whereby the tie is not readily removable from a mold when the tie is manufactured by injection molding.

SUMMARY OF THE INVENTION

The present invention provides a tie having enhanced locking engagement between the at least one pawl tooth and the first set of ratchet teeth on the tongue, and which is readily removable from a mold when the tie is manufactured by injection molding.

According to one aspect of the present invention, the tie comprises an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl, wherein the at least one pawl tooth has a locking surface extending toward an apex of said tooth at an angle inclined toward the direction of said insertion for locking engagement with the set of ratchet teeth when the tongue has been inserted through the opening with the set of ratchet teeth facing the pawl; and wherein the side of the pawl including the at least one tooth converges toward the opposite side of the pawl in said direction of insertion.

According to another aspect of the present invention, the tie comprises an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl, wherein at least one tooth of the set of ratchet teeth has a locking surface extending toward an apex of said tooth at an angle inclined away from said direction of insertion for locking engagement with the at least one pawl tooth when the tongue has been inserted through the opening with the set of ratchet teeth facing the pawl; and wherein the side of the pawl including the at least one tooth converges toward the opposite side of the pawl in said direction of insertion.

Both of the above aspects of the present invention are combined in the preferred embodiment.

Additional features of the present invention are described with reference to the detailed description of the preferred embodiments.

BRIEF DESCRIPTION OF THE DRAWING

FIG. 1 is a fragmentary sectional view of one preferred embodiment of a tie according to the present invention.

FIG. 2 is an enlarged sectional view illustrating the engagement of the ratchet teeth on the tongue with the abutment surface teeth and the pawl teeth within the locking head of the tie shown in FIG. 1.

FIG. 3 is an enlarged sectional view illustrating the engagement of the ratchet teeth on the tongue with the abutment surface teeth and the pawl teeth within the locking head of an alternative embodiment of a tie according to the present invention.

DETAILED DESCRIPTION

Referring to FIGS. 1 and 2, a preferred embodiment of the tie 10 of the present invention includes an elongated tongue 12 with two ends and two broad sides 14, 16, a locking head 18 at one end of the tongue, a tip 20 at the other end of the tongue 12, a first set of ratchet teeth 22 extending along one broad side 14 of the tongue 12 and a second set of ratchet teeth 24 extending along the other broad side 16 of the tongue 12. The locking head 18 has sides defining an opening 26 for receiving the tip 20 of the tongue 12. The sides include a movable pawl 28 that is hinged at one side of the opening 26 and an abutment wall 30 that is across the opening 26 from the pawl 28. The pawl 28 has pawl teeth 32

US005642554B1

REEXAMINATION CERTIFICATE (3857th)

United States Patent [19] [11] B1 5,642,554

Sorensen et al. [45] Certificate Issued Aug. 31, 1999

[54] CABLE TIE HAVING ENHANCED LOCKING ENGAGEMENT BETWEEN PAWL AND RATCHET TEETH ON TONGUE

[75] Inventors: Soren Christian Sorensen; Jens Ole Sorensen, both of Cayman, Cayman Islands

[73] Assignee: GB Electrical Inc., Milwaukee, Wis.

Reexamination Request:
No. 90/005,075, Aug. 17, 1998

Reexamination Certificate for:

| | |
|---|---|
| Patent No.: | **5,642,554** |
| Issued: | **Jul. 1, 1997** |
| Appl. No.: | **08/580,657** |
| Filed: | **Dec. 29, 1995** |

Certificate of Correction issued Oct. 28, 1997.

Certificate of Correction issued Dec. 1, 1998.

[51] Int. Cl.[6] ..... B65D 63/00
[52] U.S. Cl. ..... 24/16 PB; 24/17 AP
[58] Field of Search ..... 24/16 PB, 17 AP, 24/30.5 P, 17 A, 17 B, 17 R

[56] References Cited

U.S. PATENT DOCUMENTS 5,146,654 9/1992 Caveney et al. ..... 24/16 PB

FOREIGN PATENT DOCUMENTS 2054432 4/1971 France .

*Primary Examiner*—Victor N. Sakran

[57] ABSTRACT

In a tie including an elongated tongue and a locking head having a movable pawl that is hinged at one side of an opening in the locking head across the opening from an abutment surface for locking engagement with a first set of ratchet teeth on one broad side of the tongue when the tip of the tongue has been inserted through the opening and teeth on the abutment surface for locking engagement with a second set of ratchet teeth on the other broad side of the tongue when the tip of the tongue has been inserted through the opening, and in which the side of the pawl including the pawl teeth converges toward the opposite side of the pawl in the direction of insertion, locking engagement is enhanced by the locking surface of at least one pawl tooth extending toward the apex of such tooth at an angle inclined toward the direction of insertion for locking engagement with a tooth of the first set of ratchet teeth; and by the locking surface of at least one of the first set of ratchet teeth extending toward the apex of such tooth at an angle inclined away from the direction of insertion for locking engagement with a pawl tooth.

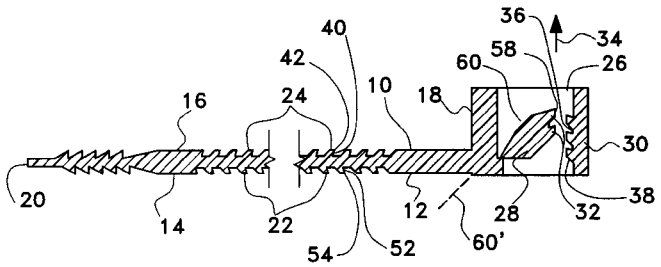

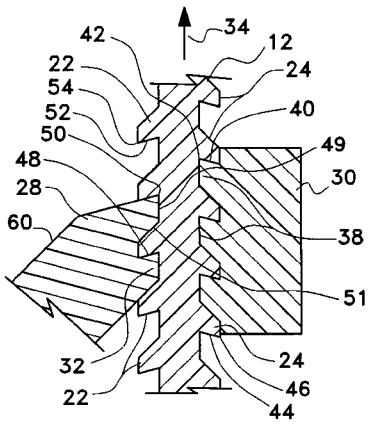

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, between lines 2 and 3 the following paragraph has been inserted:

*Each pawl tooth 32 further includes a facing surface 49 extending from the apex 50 and a trailing surface 51 extending from the facing surface 49. The trailing surface 51 does not converge toward the opposite side 60 of the pawl 28 or toward a projected extension 60' of the opposite side 60 in a direction opposite to the direction of insertion 34.*

THE DRAWING FIGURES HAVE BEEN CHANGED AS FOLLOWS:

Added reference numerals to identify the trailing surface as (51); the facing surface as (49) and the projected extension as (60).

AS A RESULT OF REEXAMINATION, IT HAS BEEN DETERMINED THAT:

The patentability of claims 2, 4, 5, 9, 11 and 12 are confirmed.

Claims 1, 3, 6, 7, 8 and 10 are cancelled.

New claims 13 and 14 are added and determined to be patentable.

*13. A tie comprising an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl,*

*wherein the at least one pawl tooth has a locking surface extending toward an apex of said pawl tooth at an angle inclined toward the direction of said insertion for locking engagement with the set of ratchet teeth when the tongue has been inserted through the opening with the set of ratchet teeth facing the pawl;*

*wherein the side of the pawl including the at least one tooth converges toward the opposite side of the pawl in said direction of insertion;*

*wherein the abutment surface also converges toward the opposite side of the pawl in said direction of insertion;*

*wherein the at least one pawl tooth further includes a facing surface extending from the apex and a trailing surface extending from the facing surface; and*

*wherein the trailing surface does not converge toward the opposite side of the pawl or toward a projected extension of said opposite side in a direction opposite to said direction of insertion.*

*14. A tie comprising an elongated tongue with two ends and two broad sides, a locking head at one end of the tongue, a tip at the other end of the tongue and a set of ratchet teeth extending along one broad side of the tongue, wherein the locking head has sides defining an opening for receiving the tip of the tongue, the sides including a movable pawl within the locking head opening that is hinged at one side of said opening and an abutment surface that is across the opening from the pawl, wherein the pawl has at least one pawl tooth disposed for locking engagement with the set of ratchet teeth when the tip of the tongue has been inserted through said opening with the set of ratchet teeth facing the pawl,*

*wherein at least one tooth of the set of ratchet teeth has a locking surface extending toward an apex of said at least one ratchet tooth at an angle inclined away from said direction of insertion for locking engagement with the at least one pawl tooth when the tongue has been inserted through the opening with the set of ratchet teeth facing the pawl;*

*wherein the side of the pawl including the at least one tooth converges toward the opposite side of the pawl in said direction of insertion;*

*wherein the abutment surface also converges toward the opposite side of the pawl in said direction of insertion;*

*wherein the at least one pawl tooth further includes a facing surface extending from the apex and a trailing surface extending from the facing surface; and*

*wherein the trailing surface does not converge toward the opposite side of the pawl or toward a projected extension of said opposite side in a direction opposite to said direction of insertion.*

* * * * *